US007488883B2

(12) United States Patent
Wang

(10) Patent No.: US 7,488,883 B2
(45) Date of Patent: Feb. 10, 2009

(54) CONSTRUCTION OF A DRUMSHELL

(76) Inventor: Wei-Bin Wang, No.183, Lifen Rd., Houli Township, Taichung County 421 (TW)

( * ) Notice: Subject to any disclaimer, the term of this patent is extended or adjusted under 35 U.S.C. 154(b) by 0 days.

(21) Appl. No.: 11/713,808

(22) Filed: Mar. 5, 2007

(65) Prior Publication Data

US 2008/0216634 A1 Sep. 11, 2008

(51) Int. Cl.
*G10D 13/02* (2006.01)

(52) U.S. Cl. ..... 84/411 M; 84/411 R

(58) Field of Classification Search ..... 84/411 R, 84/411 M

See application file for complete search history.

(56) References Cited

U.S. PATENT DOCUMENTS 635,192 A * 10/1899 Sapp ..... 84/411 R
4,519,288 A * 5/1985 Aluisi ..... 84/411 M
4,567,807 A * 2/1986 Robinson ..... 84/411 M
4,589,323 A * 5/1986 Belli et al. ..... 84/411 R
5,398,583 A * 3/1995 Cook ..... 84/411 M
5,587,543 A * 12/1996 Da Silva Marques .... 84/411 M
6,300,551 B1 * 10/2001 Adinolfi ..... 84/411 R
6,573,441 B2 * 6/2003 Norris, Jr. ..... 84/411 M
2004/0231490 A1 * 11/2004 Gatzen ..... 84/411 R
2008/0216634 A1 * 9/2008 Wang ..... 84/411 R

* cited by examiner

*Primary Examiner*—Walter Benson
*Assistant Examiner*—Robert W Horn
(74) *Attorney, Agent, or Firm*—Alan Kamrath; Kamrath & Associates PA

(57) ABSTRACT

An improved construction of a drumshell in accordance with the present invention includes a drumshell, a ring block and a muffling block. The invention is to provide an improved construction of a drumshell with specific and unique sound characteristics for playing a variety of music.

9 Claims, 3 Drawing Sheets

CONSTRUCTION OF A DRUMSHELL

BACKGROUND OF THE INVENTION

Field of the Invention

The present invention is related to a drumset and more particularly to an improved construction of a drumshell, and the construction of a drumshell can adjust the natural resonating or resonating time, so that the drumset having specific and unique sound characteristics for playing a variety of music.

The present drumshell material is made of wooden sheets which are joined, so that when performance, the drumset only can display the single tone color, and if we want to adjust the timbre, we need other assistance tuning appliance to set it.

The apparatus enables a drum tuning method capable of tuning to different environments, e.g. a live show or a recording studio, providing a drumshell having a more natural resonating sound to reduce resonating time of the reverberating drum by damping the drum sound to change resonating time or providing a material to absorb high frequency vibration, such as a sponge, to achieve a special tone or pitch.

In fact, for the user, the above or other tuning method can be used to set a suitable tone color. However, it is necessary for the user to carry tuning appliance, thereby causing inconvenience to the user.

The present invention intends to provide a washer having oil-bearing portions provided on an inner surface to thereby guide the lubricant leaking from a bearing to form a lubricant layer on the end surface of the bearing in such a way to mitigate and overcome the above problem.

SUMMARY OF THE INVENTION

The primary objective of this invention is to provide an improved construction of a drumshell in which the ring block connects a ring socket of the drumshell to change frequency of the sound for adjusting the natural resonating.

Another objective of this invention is to provide an improved construction of a drumshell in which the muffling block connects the connecting socket of the ring block to have sound absorption effect for adjusting the resonating time.

Another objective of this invention is to provide an improved construction of a drumshell with specific and unique sound characteristics for playing variety of music.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
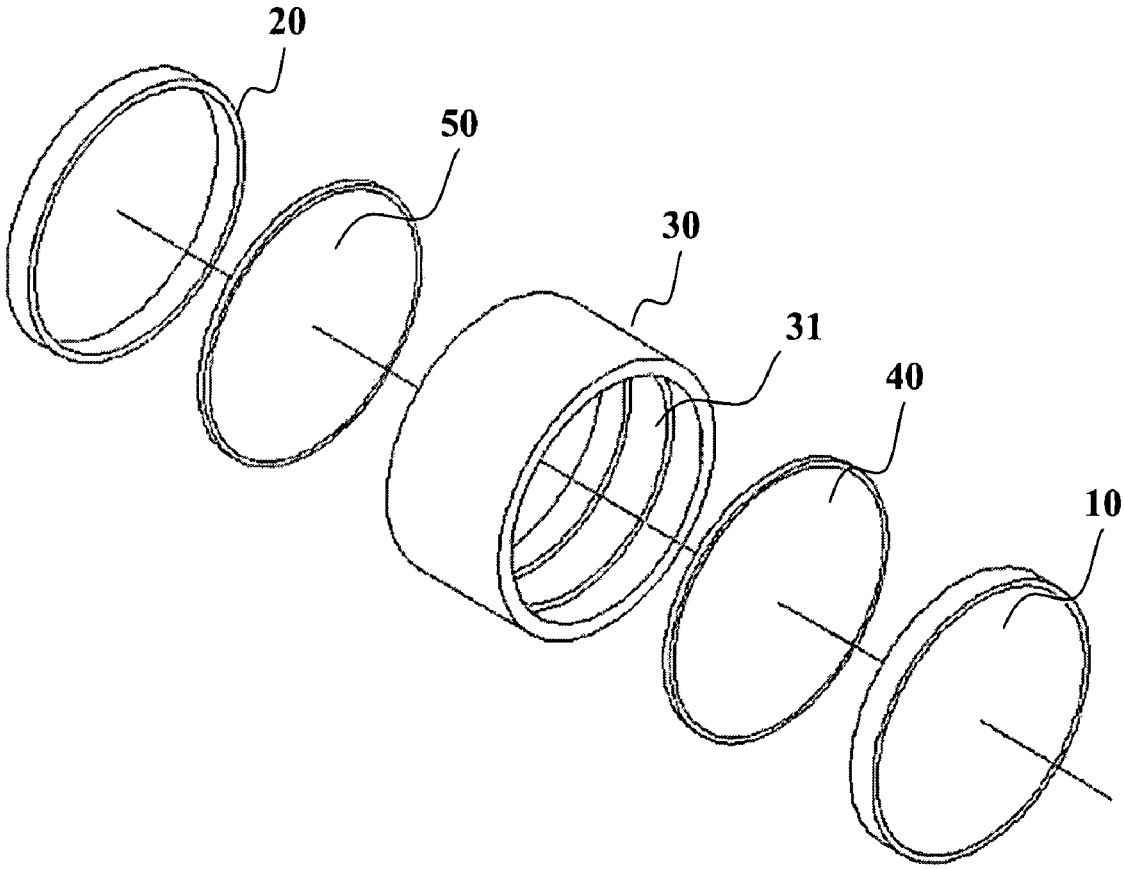
FIG. 1 is an exploded view of an improved construction of a drumshell in accordance with a first embodiment of the present invention.

Referring now to the drawings, there are seven embodiments of the present invention shown therein, all of which include generally a primary washer member and a secondary motor member.

Figure 2:
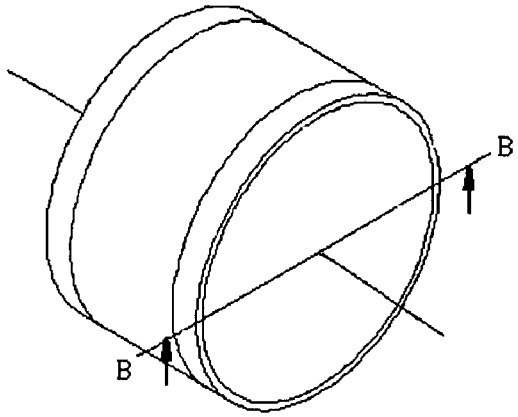
FIG. 2 is a perspective view of an improved construction of a drumshell in accordance with the first embodiment of the present invention.

Referring initially to FIGS. 1 and 2, a drumset designated as numeral 1 includes a upper hoop rim as numeral 10, a lower hoop rim as numeral 20, an improved construction of a drumshell as numeral 30, a ring socket as numeral 31, a ring block as numeral 32, a muffling block as numeral 33, a connecting socket as numeral 34, a upper drumhead as numeral 40, and a lower drumhead as numeral 50.

Figure 3:
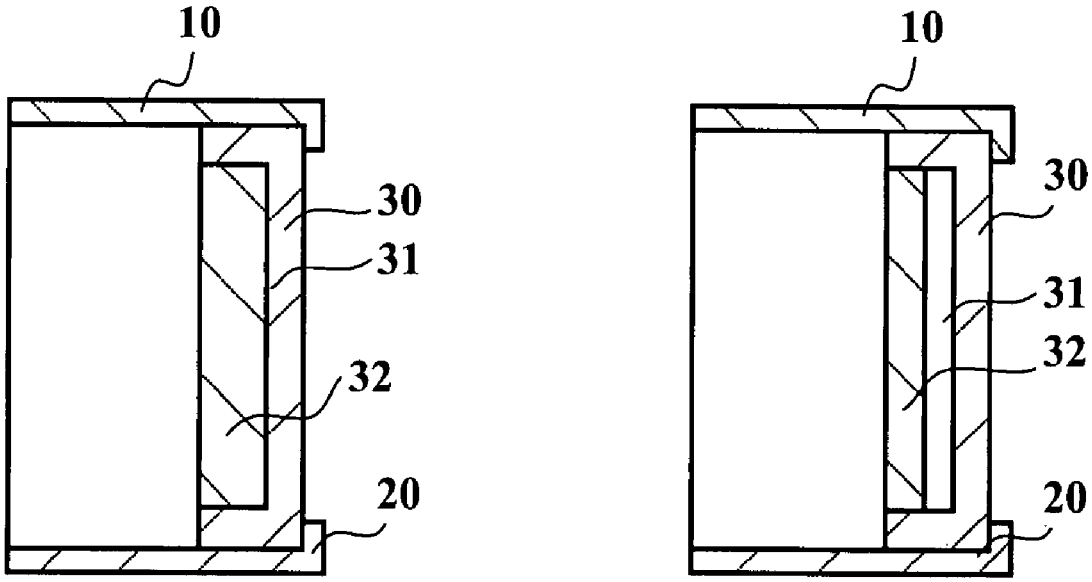
FIG. 3 is a cross-sectional view of an improved construction of a drumshell in accordance with a second embodiment of the present invention.

Referring to FIGS. 1 through 3, the pattern in accordance with the first embodiment of the present invention includes a drumshell 30 and a ring block 32. The drumshell 30 has a ring socket 31 which is connected with the ring block 32 so that the drumshell 30 and the ring block 32 are able to change sound frequency of the drumshell for adjusting the natural resonating, and the ring socket 31 is comprised of a variety of materials, including, for example, wood, steel, carbon fiber and fiberglass.

Figure 4:
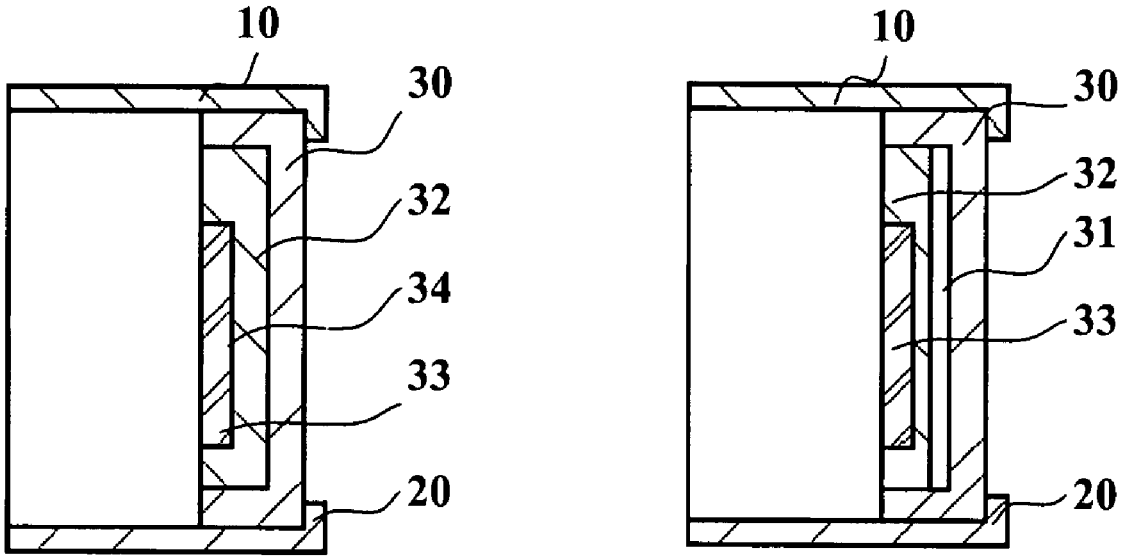
FIG. 4 is a cross-sectional view of an improved construction of a drumshell in accordance with a third embodiment of the present invention.

Referring to FIG. 4, reference numerals of second embodiment of the present invention includes a drumshell 30, a ring block 32 and a muffling block 33. The ring block 32 has a second connecting socket 34 secured to the muffling block 33, and the muffling block 33 is comprised of variety of materials to reflect and absorb different frequency pitches to adjust different tones for different performance.

Figure 5:
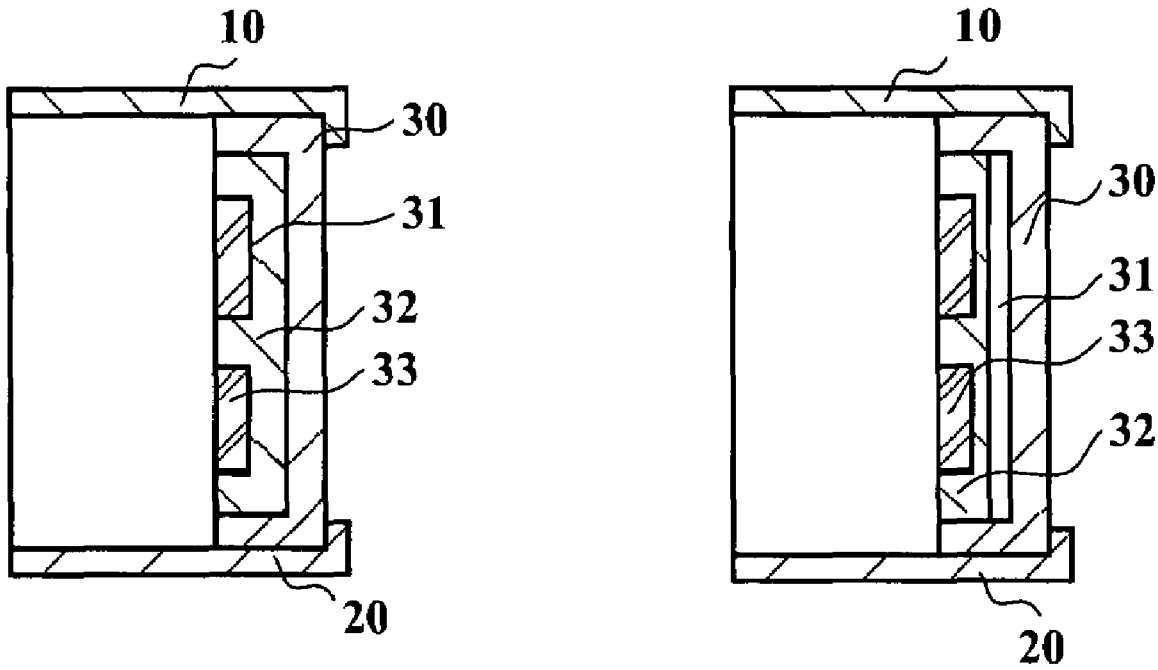
FIG. 5 is a cross-sectional view of an improved construction of a drumshell in accordance with a fourth embodiment of the present invention.

Referring to FIG. 5, reference numerals of third embodiment of the present invention includes a drumshell 30, a ring block 32 and a muffling block 33, and the ring block 30 has at least connecting socket 34 secured to the muffling block 33 for sound attenuating a drumhead with desired acoustic effects.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A drumshell construction comprising:

a drumshell having an inner surface with a first channel;

a block mounted in the first channel of the drumshell and having an inner surface provided with at least one second channel; and at least one muffling block mounted in the at least one second channel of the block.

2. The drumshell construction as defined in claim 1, wherein the block is sandwiched between the at least one muffling block and the drumshell.

3. The drumshell construction as defined in claim 1, wherein the inner surface of the drumshell has a protruding peripheral wall encompassing an outer periphery of the block;

the block is fully received in and limited by the protruding peripheral wall of the inner surface of the drumshell.

4. The drumshell construction as defined in claim 3, wherein the block has an end face flush with an end face the protruding peripheral wall of the inner surface of the drumshell.

5. The drumshell construction as defined in claim 1, wherein the inner surface of the block has a protruding peripheral wall encompassing an outer periphery of the muffling block;

the muffling block is fully received in and limited by the protruding peripheral wall of the inner surface of the block.

6. The drumshell construction as defined in claim 5, wherein the muffling block has an end face flush with an end face the protruding peripheral wall of the inner surface of the block.

7. The drumshell construction as defined in claim 1, wherein the block is fully received in the first channel of the drumshell.

8. The drumshell construction as defined in claim 1, wherein the at least one muffling block is fully received in the at least one second channel of the block.

9. The drumshell construction as defined in claim 1, wherein the drumshell, the block and the muffling block laminate each other.

* * * * *